United States Patent [19]

Wang et al.

[11] Patent Number: 4,534,427

[45] Date of Patent: Aug. 13, 1985

[54] ABRASIVE CONTAINING FLUID JET DRILLING APPARATUS AND PROCESS

[76] Inventors: Fun-Den Wang, 108 S. Eldrige Way, Golden, Colo. 80401; Gene G. Yie, 29244 - 59th Ave. South, Auburn, Wash. 98002

[21] Appl. No.: 517,000

[22] Filed: Jul. 25, 1983

[51] Int. Cl.[3] ..... E21B 7/18

[52] U.S. Cl. ..... 175/67; 175/70; 175/104; 175/107; 175/393; 175/422; 239/424; 299/17

[58] Field of Search ..... 175/67, 69, 70, 422, 175/393, 104, 106, 107, 205, 92; 239/105, 310, 325, 424; 299/17, 16

[56] References Cited

U.S. PATENT DOCUMENTS

| | | | |
|---|---|---|---|
| 1,390,025 | 9/1921 | Drake | 175/70 |
| 1,512,140 | 10/1924 | Schaub | 175/67 |
| 2,609,182 | 9/1952 | Arutunoff | 175/104 |
| 3,055,442 | 9/1962 | Prince | 175/422 |
| 3,212,217 | 10/1965 | Furgason | 239/424 |
| 3,713,699 | 1/1973 | Johnson, Jr. | 239/424 |
| 3,819,519 | 6/1974 | Sharman et al. | 175/69 |

FOREIGN PATENT DOCUMENTS

| | | | |
|---|---|---|---|
| 109272 | 7/1925 | Switzerland | 175/422 |
| 2095722 | 10/1982 | United Kingdom | 299/17 |
| 523980 | 11/1976 | U.S.S.R. | 299/17 |

*Primary Examiner*—Stephen J. Novosad
*Assistant Examiner*—Hoang C. Dang
*Attorney, Agent, or Firm*—Thomas W. Speckman

[57] ABSTRACT

An abrasive-fluid jet apparatus and process for drilling holes in rock having a rotary drill bit with multiple abrasive-fluid jet nozzles in the face of the bit and a stationary drill head housing torque generation apparatus and a rotary mounting holding the rotary drill bit beneath and in rotatable relation to the drill head. Abrasive supply facilities and fluid supply facilities are located at ground level for separate supply of the abrasive and the fluid to the abrasive-fluid jet nozzles. It is preferred that the abrasive be supplied to the nozzles in the form of slurry or foam. The apparatus and process of this invention permits deep hole drilling at lower fluid pressures than and without surface structures required by current deep drilling apparatus and techniques.

20 Claims, 15 Drawing Figures

ABRASIVE CONTAINING FLUID JET DRILLING APPARATUS AND PROCESS

BACKGROUND OF THE INVENTION

1. Field of the Invention

This invention relates to apparatus and process for drilling deep holes through hard natural formations, such as rock. More particularly, this invention relates to apparatus and process for cutting rock by means of high-velocity fluid jets containing abrasive particulates. The apparatus and process of this invention relates in one embodiment particularly to a rotating drill bit, through which high-velocity abrasive fluid jets are emitted, that could be lowered into the ground and advances automatically to drill a hole through rock. The apparatus and process of this invention relates in another embodiment to use of two conduits for separately transporting high pressure fluid and abrasive particulate containing slurry or foam over a long distance to a rotary drill bit for generating abrasive fluid jets capable of cutting hard rock. The apparatus and process of this invention are particuarly well suited for drilling wells to extract water, hydrocarbons, minerals, and geothermal resources.

2. Description of the Prior Art

The conventional methods of drilling holes through rock involve the use of a rotating drill bit having cutting edges capable of crushing rock when force is applied by the rotating drill bit against the rock. To provide thrust and rotate the drill bit against rock requires power input and suitable means of transmitting the power from a prime mover to the rotary drill bit. In drilling wells for extracting hydrocarbons, such as oil and natural gas, drill pipes are used to transmit the torque from an engine to a downhole drill bit. This drilling method has many shortcomings that contribute to the high cost of such operations. Conventionally, drill pipes are supplied in 40 foot sections and must be threaded together to form a long distance torque transmitting drill pipe. Threading drill pipes takes time and labor and thus slows down the drilling and increases the cost. Drill pipes are heavy and require the erection of an elaborate tower structure to conduct the drilling operation. The torque transmitting capability of drill pipes is quite limited, thus limiting the level of power that could be applied to the bit. The drill pipe can be jammed against or rub against the rock surface at the side of the hole causing damage to the drill pipe or loss of useful power. Due to the very high level of thrust and torque that must be applied to the cutting edges of the drill bit to cut hard rock, the life of cutting edges is short and frequent replacement of cutting edges results in very costly downtime. In practice, the inability of a drill pipe to transmit high torque and the inability of the drill bit to withstand high thrust and torque limit the power that can be applied to the rock surface to about 10 to 25 hp in conventional rotary drilling.

To overcome the power transmitting limitation of the drill pipe and to prolong the life of a drill bit by reducing the required thrust, various means of high pressure fluid jetting have been attempted. A review of such techniques is set forth in "Novel Drilling Techniques" by W. C. Maurer, Pergamon Press, Oxford, England (1968). In one approach, high pressure fluid is transmitted to the drill bit by means of pipes or high pressure tubing to generate high velocity fluid jets which are directed against the rock surface to cut a groove and to facilitate the cutting edges in breaking the rock. The use of such fluid jets has been shown to reduce the thrust required to cut rock, thus reducing the wear of the drill bit. However, the effectiveness of the fluid jets in cutting grooves is governed essentially by the pressure differential of the high pressure fluid and the down hole ambient fluid pressure and very high fluid pressure, such as that capable of providing a pressure differential of more than 15,000 psi, is required to effectively cut hard rock. In such cases, the transportation of the pressurized fluid from the surface pump to the drill bit becomes a problem if the depth of drilling is substantial. Further, pumping a large volume of fluid to a pressure level such as 30,000 psi also presents a problem. The use of high pressure fluid jets to aid rotary drill bits is discussed in Maurer, W. C. and Heilhecker, J. K., "Hydraulic Drilling", Proceedings, Fourth Symposium on Drilling and Rock Mechanics, University of Texas, Austin (1968), and Maurer, W. C., Heilhecker, J. K. and Love, W. W., "High Pressure Drilling", Journal of Petroleum Technology (July, 1973).

Because of the difficulties in compressing fluid to very high pressures and in transporting the pressurized fluid over a long distance, the fluid jet approach of drilling wells is not currently practiced. However, the benefits of fluid jet augmented rock cutting techniques have been well demonstrated. This approach, in fact, is currently being employed to cut rock in tunneling applications in which high pressure water jets of 40,000 psi or higher are used to cut concentric grooves in rock and trailing disk cutters are employed to crush the concentric rings of rock delineated by the water jet made grooves. This approach resulted in the reduced thrust requirement for equal or better cutting rate such that the power requirement and/or the weight of the tunnel machine could be reduced.

In order to achieve the benefits of the fluid jet assisted drilling, without having to pressurize the fluid to an impractical level, addition of abrasive particules to the fluid to improve the fluid jet's capability in cutting hard rock has been investigated. Selected abrasive particulates have been added to the drilling fluid, which was pumped down hole to a drill bit equipped with suitable jet generating nozzles. The abrasive fluid jet approach of cutting rock in drilling applications has been discussed in the following references: Fair, J. C., "Development of High Pressure Abrasive Jet Drilling", Journal of Petroleum Technology, August, 1981, and U.S. Pat. No. 3,112,800 teaching use of abrasive fluid jet to cut the periphery of a circular rock core, which is subsequently removed by a roller bit; U.S. Pat. No. 3,389,759 teaching placing an abrasive fluid jet nozzle inside a nozzle holder that could be retrieved with a wire line through the drill pipe; U.S. Pat. No. 3,548,960, teaching a rock drill that utilizes abrasive fluid jets to cut kerfs and stand-off elements to mechanically aid in removing the ridges formed between the kerfs; U.S. Pat. No. 3,231,031, teaching an abrasive fluid jet to drill a pilot hole in rock just ahead of a rock bit and a water hammer effect produced by lowering the drillstring to the pilot hole to shut off the fluid flow to impact the bit against the rock and to fracture the rock around the pilot hole; and U.S. Pat. No. 3,324,957, teaching use of high velocity hydraulic jets to drill a pilot hole which is enlarged by high velocity hydraulic jets from a tapered drilling tool. Wyllie, M. R. J., "Jetted Particle Drilling", Proceedings, 8th World Petroleum Congress, Moscow, U.S.S.R. (1971) summarizes extensive tests to impact and abrade selected rock specimens with drilling fluid formulas that contain various types of abrasive materials.

The prior art teachings relative to cutting rock with abrasive containing fluid jets all involve adding selected abrasive materials to the drilling fluid or mud and compressing this mixture to the desired pressure and through the drill pipe to a rotary bit having nozzles capable of forming fluid jets. The abrasive materials include sand and steel shots of selected grain sizes. The prior art demonstrates that with an abrasive containing fluid jet the drill rate against hard rock can be significantly increased and the life of bit prolonged. However, the wear of pump parts, swivel packings, and nozzles by the abrasive materials added to the drilling fluid was found to be excessive and difficult to avoid. As a result, none of these prior art teachings are currently practiced in drilling wells.

There have been various attempts to provide abrasive containing fluid jet streams. U.S. Pat. Nos. 3,424,386, 3,972,150, 4,080,762 and 4,125,969 all teach the abrasive (sand) stream to be in the central portion of the nozzle while the pressurized fluid is introduced into the peripheral area surrounding the central sand stream. A ring orifice plate or disk such as employed in the U.S. Pat. Nos. 3,424,386, 4,080,762 and 4,125,969 to provide the fluid jets around the sand stream has many disadvantages including: the introduction of pressurized fluid tangentially into a nozzle a short distance above the orifice disk is not conducive to the generation of a coherent fluid jet due to flow disturbances upstream of the orifices; sand in the central portion of a nozzle creates an abrasive environment that can weaken the interior wall of the annular fluid chamber without being detected; pressurized fluid in the outer annular space results in a nozzle that is very large in dimensions as both interior and exterior walls must be sized to accommodate the fluid pressure; and sealing the annular orifice disk can be very troublesome. U.S. Pat. No. 3,994,097 teaches a centrally located water jet while sand is fed into a nozzle chamber through a single sand passageway. The sand is forced into the water jet by passage through a conical nozzle. This patent recognizes abrasion problems within the nozzle and the necessity of exact alignment. These problems would be intensified at higher pressures. All of these patents teach mixing abrasive into water by (1) intercepting an abrasive stream with water jets, and (2) forcing abrasives, water and air through a conical nozzle, without concern of fluid actions.

The prior art devices have generally utilized compressed air to deliver the abrasive particles to a nozzle in which the particles are mixed with the water stream. It is desirable, however, for the particles to be wetted by water before they are to be most effectively mixed with the water. Further, if the water stream is coherent and is traveling at high speed, the conditions are not favorable for the air propelled particles to be mixed into the water stream. At best, some particles are carried away by the water droplets formed around the coherent core of the water stream. The introduction of abrasive particles would be significantly improved if the water jet is made to disperse into droplet form, however, the resultant abrasive water jet would be weak and incapable of cutting hard materials.

The transporting of abrasive particles by compressed air or gas also has other undesirable characteristics. Since abrasive particles are generally heavy, the air flow must be sufficiently turbulent to move the particles, otherwise the particles will settle and block the passage. The air or gas must be dry to avoid agglomeration of particles and resulting blockage of the passage. Further, erosion of tubing, hoses and fittings by the abrasive particles is a common problem.

A possible alternative approach of transporting abrasive particles to the nozzle is to convert the abrasives to a slurry as taught by U.S. Pat. No. 3,972,150 relating to a hand held gun. This abrasive slurry is then pumped into a nozzle and mixed with the water jet. One problem of this approach is that the slurry must be mixed into the water jet, the mixing of which can consume a significant amount of the water jet's kinetic energy as the slurry, rather than the individual abrasive particles, must be accelerated to the water jet velocity. Such loss of water jet energy can be particularly severe if the abrasive slurry is viscous. These problems are increased by the fact that high viscosity may be necessary in formulating such an abrasive slurry, if settlement of the particles is to be avoided.

SUMMARY OF THE INVENTION

This invention relates to an apparatus and process for drilling holes in hard rock, particularly in drilling holes for extracting hydrocarbons from rock formations. By the term "rock" as used throughout this disclosure and claims, all hard materials are included, such as granite, sandstone, shale, coal and all types of mineral matter. The apparatus and process may also be used for drilling holes in softer earth materials. The apparatus and process involves the use of abrasive containing fluid jets to cut grooves in rock and hard cutting edges to crush and remove the rock situated between cuts made by the fluid jets. It, however, differs from the prior art in several significant aspects. The abrasive material is delivered to the fluid jet nozzle in a stable liquid slurry or foam separate from the pressurized fluid used to form the abrasive containing fluid jets. The fluid jets may be formed using water, drilling mud, drilling fluid or any fluid formulated to meet certain drilling conditions. The apparatus and process of this invention utilizes a stationary drill head providing torque to a rotary bit having abrasive containing fluid jets for cutting multiple concentric grooves and mechanical cutters for removal of material between the grooves. The torque for the rotary bit is provided by a driving mechanism within the stationary drill head operated by pressurized fluid or an electric motor completely eliminating the need of a drill pipe as required by the prior art systems. The pressurized fluid may be provided to the drill head by means of coiled hoses or tubing, thus obviating the need for a tower structure. The thrust required by the rotary bit is supplied by the weight of the bit, drill head and hoses.

The process of this invention for drilling holes in hard materials, such as rock, is performed by forming multiple fluid jet streams containing abrasive particles in multiple nozzles spaced in the face of a rotary drill bit, the abrasive-fluid jet streams jetting from the nozzles at about 20 to 90 and preferably about 45 to 90 degree angles to the face of the rotary drill bit. The abrasive particles and the pressurized fluid are supplied to the nozzles separately and the abrasive-fluid jet stream formed within the nozzle, the orifices for generating the fluid jets not being contacted by the abrasives. The rotary drill bit is rotated in relation to an adjacent stationary drill head by a torque generation means within the drill head. In preferred embodiments, the torque generation means may be powered by the pressurized fluid prior to passing through the nozzle orifices and in other preferred embodiments is powered by an electric motor geared to the rotary drill bit and housed within the drill head. Rotation of the rotary drill bit with the abrasive fluid jet streams cuts concentric grooves in rock adjacent the face of the rotary drill bit and rock between the grooves is removed by mechanical cutters spaced on the face of the rotary drill bit between the fluid jet nozzles.

The apparatus according to this invention for drilling holes in hard materials, such as rock, has a rotary drill bit with multiple abrasive fluid jet nozzles spaced to cut concentric grooves in adjacent rock upon rotation and has mechanical cutters spaced between the fluid jet nozzles to remove remaining rock materials between the grooves upon rotation. A drill head housing torque generation means and rotary mounting means holds the rotary drill bit in rotatable relation to the drill head. Abrasive supply means supplies abrasive, preferably in slurry or foam form, to the abrasive fluid jet nozzles and fluid supply means supplies pressurized fluid to the nozzles separate from the supply of abrasives. It is an important aspect of the apparatus of this invention that the abrasives and the pressurized fluid are mixed to form the abrasive-fluid jet within the nozzles downstream from the orifices generating fluid jets.

The abrasive-fluid mixing devices used in this invention provide pressurized fluid flow through the central portion of a nozzle and particulate introduction peripherally. Thus, the fluid flow is not disturbed and the peripheral portion of the nozzle may be readily adapted to accommodate a wide variety of particulate requirements, such as volume. The nozzles used in this invention provide improved fluid jet quality and preferably utilize multiple fluid jets and flow shaping construction to provide a conical volume of reduced pressure in the central portion of the fluid jet to readily entrain and accelerate the particulates in the fluid jet stream. Coherent, well mixed abrasive-fluid jets are provided by the apparatus and process of this invention.

One embodiment of the process and apparatus of this invention is to provide the abrasive particles contained in a foam for mixture with a fluid jet stream. As the foam containing the abrasive particles contacts the fluid stream, the gaseous bubbles dispersed throughout the foam will collapse and the abrasive particles dispersed in the bubble film throughout the foam will be carried away by the fluid stream. The foam containing the abrasive particles provides a particle of wetted surface to the fluid stream and presents little interference to the fluid stream as the foam is largely gaseous bubbles with much less amount of liquid than experienced with prior particulate containing slurries. Therefore, the energy loss of the fluid jet in principally accelerating the solid particulates is much less than instances wherein slurries of particulates were introduced. The transport of the solid particulates in foam is advantageous since the foam containing solids can be readily released under pressure or pumped through tubing over a long distance without settling of the solids and with reduced wear or abrasion problems. The transport of solid particles by foam also provides much better control over introduction of solid particulates into the fluid stream since more precise control over the pumping range or regulation of rate of release of pressurized foam may be readily achieved. In accordance with the introduction of abrasive solid particulates to a fluid stream by practice of this invention, high amounts of abrasive particles may be introduced into the fluid jet stream and the resultant drill bit with abrasive-fluid jet streams has drilling capabilities not previously attainable. The properties of the foam used for wetting, carrying and introduction of solid particulates into the fluid stream can be readily adjusted to meet special needs by varying formulations, such as to obtain control of bubble size, solids content, rheological properties, freezing temperatures, abrasion capabilities, and the like.

BRIEF DESCRIPTION OF THE DRAWING

Specific embodiments of apparatus suitable for use in this invention are shown in the drawing wherein.

DESCRIPTION OF PREFERRED EMBODIMENTS

Figure 1:
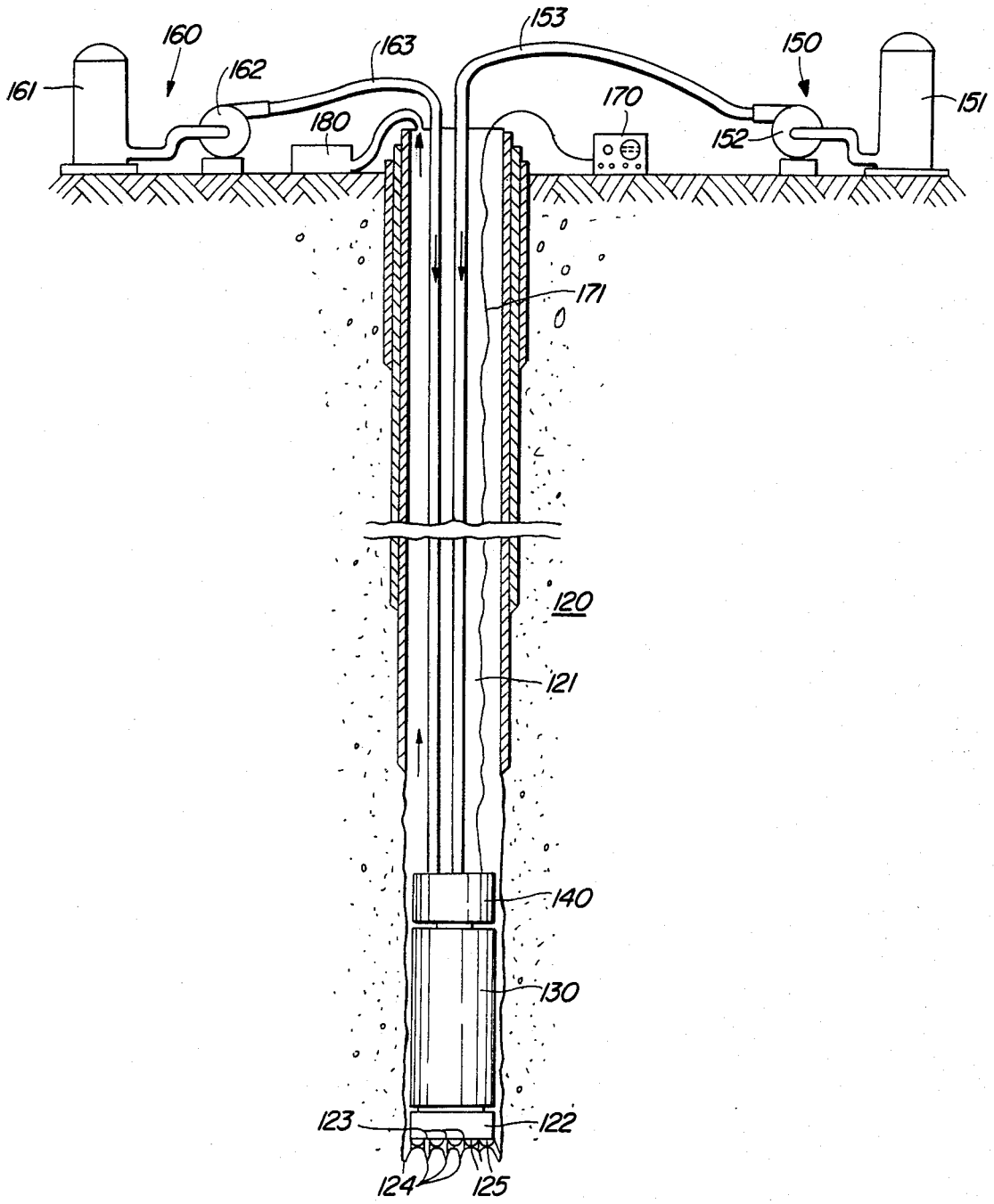
FIG. 1 is a diagramatic cross-sectional view of an abrasive-fluid jet hole drilling system according to one embodiment of this invention.

Referring to FIG. 1, the hole drilling system of this invention is shown drilling hole 121 through rock 120. Rotary drill bit 122 has three abrasive-fluid jet nozzles 123 which when the drill bit is rotated cuts concentric grooves 124 in the rock adjacent the drill bit face. The face of rotary drill bit 122 also has mechanical cutters 125 between the fluid jet nozzles to remove the rock from between grooves 124 upon rotation of drill bit 122. Stationary drill head 130 is just above drill bit 122 and houses torque generation means and rotary mounting means holding rotary drill bit 122 in rotatable relation to drill head 130. Thus, there is little or no loss of torque that is to be transmitted to rotary drill bit 122. Sensor and control means 140 may be within or just above stationary drill head 130. The surface equipment required to apply the apparatus and process of this invention to drill holes is simplified and includes mainly fluid supply means 150 and abrasive supply means 160 with preparation and storage means 151 and 161, pump means 152 and 162 and conduit supply means 153 and 163, respectively, and control means 170 with control communication means 171. Recirculation or withdrawal means 180 is provided to remove liquid and slurry materials from hole 121. This equipment can readily be mounted on vehicles, resulting in significantly improved mobility. FIG. 1 also shows the use of supply hoses/tubings 153 and 163 and cable 171 which can be supplied in coil form of great length, thus significantly increasing the speed of operation in lowering or retrieving stationary drill head 130 and rotary drill bit 122. Such coiled hose, tubing, and cable can be easily mounted on vehicles for mobility. It should also be readily apparent that multiple fluid conduits or multiple abrasive conduits may be used. Since the thrust exerted against the rock by the rotary drill bit is supplied by the weight of the apparatus, it is thus basically self-advancing and is capable of starting a hole right on the ground surface.

Figure 2:
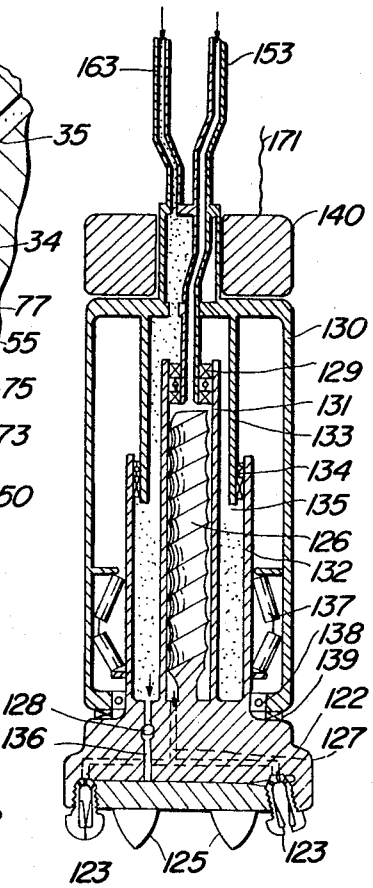
FIG. 2 is a cross-sectional view showing a rotary drill bit with abrasive-fluid jet nozzles in combination with a stationary drill head according to this invention.

FIG. 2 shows a sectional side view of a rotary drill bit and drill head according to one embodiment of this invention in which torque for rotation of the drill bit is provided by a fluid-driven rotor within the drill head. As shown in FIG. 2, drill head 130 provides a stationary base for rotably mounting rotary drill bit 122 and provides fluid-driven torque necessary for rotating drill bit 122. High pressure fluid is supplied by high pressure fluid conduit 153 to high pressure cylinder 131 housing rotary screw 126 which is in non-rotatable relationship with drill bit 122. Thus, high pressure fluid passing through high pressure cylinder 131 over rotary screw 126, or other suitably shaped rotor, rotates the rotor and thus rotates drill bit 122. The pressurized fluid leaves the bottom of high pressure cylinder 131 through conduits 127 which leads to the fluid supply means for each of the abrasive-fluid jet nozzles 123. High pressure seal 129 may be of any suitable design known to the art for retaining high pressure fluid within high pressure cylinder 131 and permitting its rotation about high pressure fluid inlet conduit 153. Rotary drill bit 122 has upstanding cylinder 132 which engages with downwardly appended cylinder 133 from the top of drill head in suitable sealing engagement by bearing 134 forming abrasive reservoir 135. Abrasive slurry or foam enters abrasive reservoir 135 through abrasive supply conduit 163 and passes from the bottom of abrasive reservoir 135 through check valve 128 and abrasive conduit 136 to each of the abrasive-fluid jet nozzles 123. Free rotation of rotary drill bit 122 with respect to drill head 130 is further facilitated by suitable bearings 138 and suitable thrust bearings 137. Additionally, seal 139 may be provided to prevent foreign materials from entering the bearing areas. The bottom face of drill bit 122 is substantially flat and cutting edges 125 serve as standoffs for the abrasive-fluid jets and remove material from the ridges between the grooves cut by the abrasive-fluid jets. As shown, one abrasive-fluid jet is at a 90° angle to the front face of the drill bit and the other abrasive fluid jet at about a 75° angle to the face of the drill bit. Suitable sensors, controls and instrumentation needed for operation are housed within sensor and control means 140 which may be either within drill head 130 or, as shown, separate from but riding on top of drill head 130 with communication cable 171 leading to surface control equipment.

Figure 3:
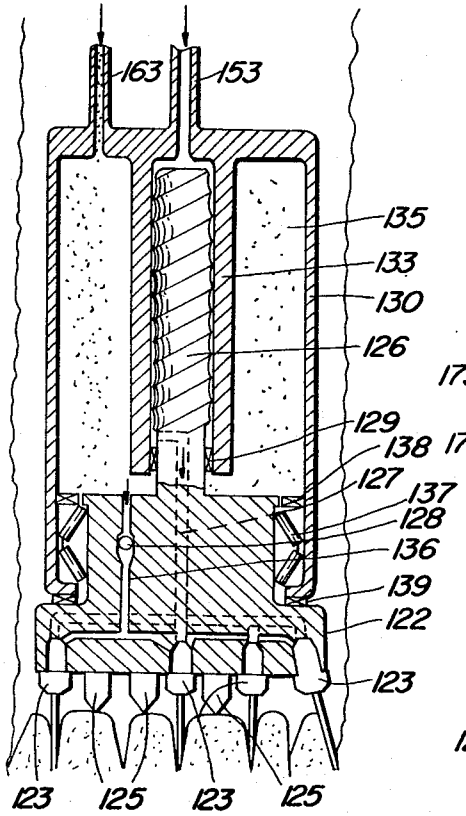
FIG. 3 is a cross-sectional view of another embodiment of a rotary drill bit and stationary drill head according to this invention.

FIG. 3 illustrates another embodiment of a suitable drill head and high pressure fluid-driven rotary drill bit. In the embodiment shown in FIG. 3, downstanding cylinder 133 from the top of drill head 130 forms the high pressure fluid chamber for operation of rotary screw 126. High pressure fluid enters the chamber through conduit 153, passes over rotary screw 126 causing rotation of drill bit 122 and passes through conduits 127 which lead to the fluid supply means for each of the abrasive jet nozzles 123. The abrasive reservoir is formed between the exterior of down-standing cylinder 133 and the interior of drill head 130. Abrasive is supplied by abrasive conduit 163 to the abrasive reservoir 135 and passes from the bottom of abrasive reservoir 135 through check valve 128 and abrasive conduit 136 to each of the abrasive-fluid jet nozzles 123. Bearings 129 and 137 assure free rotation of drill bit 122 with respect to drill head 130. Thrust bearing 137 is protected from foreign matter by seals 138 and 139. The embodiment shown has four abrasive-fluid jet nozzle assemblies 123 in the face of rotary drill bit 122. Mechanical cutters 125 are provided between abrasive-fluid jet nozzles to mechanically remove the ridges between grooves cut by the abrasive-fluid jets.

Figure 4:
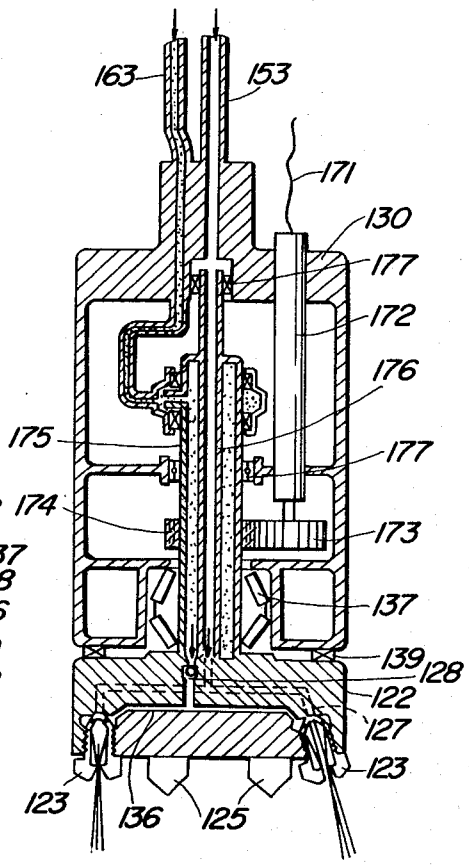
FIG. 4 is a cross-sectional view showing another embodiment of a rotary drill bit and stationary drill head according to this invention.

FIG. 4 shows another embodiment of a rotary drill bit and stationary drill head according to this invention which is powered by an electric motor. Electric motor 172, powered by and controlled by cable 171, provides torque to gear 173. Rotary drill bit 122 has upstanding cylindrical portion 175 forming with high pressure fluid tube 176 an annular abrasive material reservoir. High pressure fluid flows directly from conduit 153 through high pressure fluid tubing 176 into fluid conduits 127 to abrasive-fluid jet nozzle assembles 123. The abrasive foam or slurry is supplied by conduit 163 and passes into the annular reservoir by a suitable annular feed means, through check valve 128 and conduit 136 to each abrasive-fluid jet assembly 123. Rotary drill bit 122 is supplied torque through gear 174 fixedly mounted on cylinder 175 and engaging gear 173. Although shown in FIG. 4 as an electric motor, it is readily apparent that a fluid driven rotor torque generating device, as disclosed in FIGS. 2 and 3, may be used in place of electric motor 172 for providing torque to gear 173 and driving rotary drill bit 122.

It is readily apparent, following reading of this disclosure, that the diameter of the rotary drill bit can be provided in various sizes and the number of abrasive-fluid jet nozzles can be provided in different numbers, different types as will described later herein, and at different angles to the drill bit face to suit a wide variety of drilling conditions. By positioning a suitable number of abrasive jet nozzles in the face of the drilling bit, very hard rock ridges between the concentric grooves formed by the abrasive jet streams can be crushed by mechanical cutting edges of various types known to the art under moderate torque and thrust, thus prolonging the life of the mechanical cutting edges.

Figure 5:
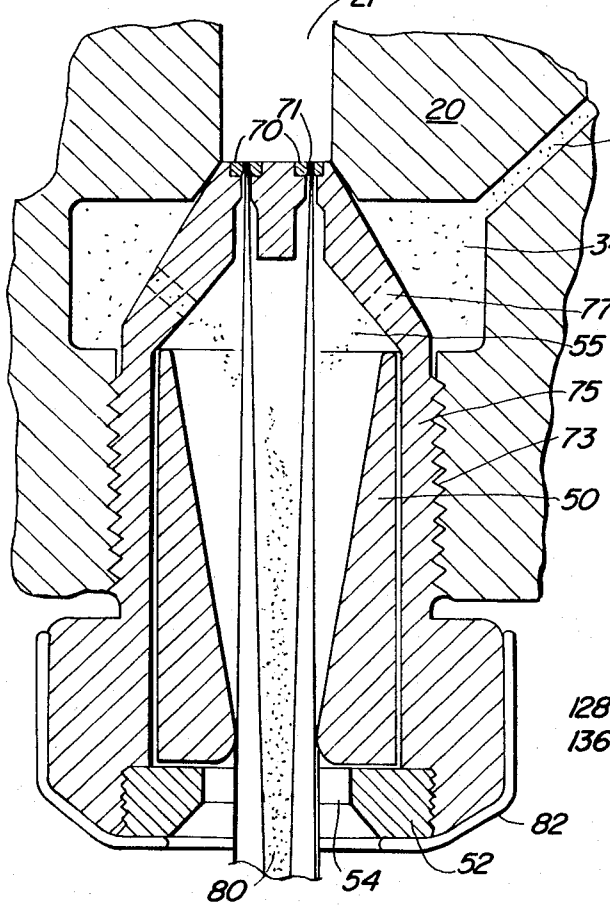
FIG. 5 is a cross-sectional view showing a suitable abrasive-fluid jet nozzle for use in this invention.

FIG. 5 shows one embodiment of a nozzle and orifice cone suitable for forming abrasive-fluid jets for use in this invention wherein orifice cone 75 has external threads 73 for screwing directly into the lower portion of nozzle body 20. Nozzle body 20 may be rotary drill bit 122 or a nozzle assembly may be made with body 20 which may be suitably inserted or attached to drill bit 122. Suitable modifications will be apparent in all the specific embodiments shown in Figs. 5–14. Fluid jets are provided by high pressure fluid passing through orifices 71 in orifice plates 70 from pressurized fluid chamber 21. Abrasive particles are supplied by solids feed means 35 to solids chamber 34 for feeding through solids orifices 77 into mixing chamber 55. Flow shaping cone 50 is loosely retained within the bottom portion of orifice cone 75 by support nut 52 having passage 54. Abrasive-fluid jet 80 passes from the nozzle. As shown in FIG. 2, orifice support cone 75 may be mounted in the body 20 of the rotary drill bit by threaded means. The flat top of the cone-shaped nozzle body has one or more orifice plates 70 having centrally located orifice 71 of selected geometrics and sizes. The high pressure fluid enters into the orifices from the top and exits at the bottom in the form of high velocity jets. A tapered fit between the cone 75 and body 20 forms the high pressure seal and separates the high pressure fluid from the abrasive slurry in communication with the periphery of the tapered side of the nozzle body in solids chamber 34. The abrasive slurry enters into the interior of the nozzle body through one or more solids orifices 77 situated around the tapered side. A cylindrical flow-shaping cone 50 having tapered internal volume restricts the open space around the fluid jet, thus forcing the abrasive solids to mix with the fluid jet and generating suction or vacuum inside the nozzle body to aid the introduction of abrasives. The flow-shaping cone has an opening sized according to the fluid jets such that little or no space is left around the fluid jets. Support nut 52 keeps the flow-shaping cone inside the nozzle body and a protective cover 82 protects the exterior of the nozzle body against the abrasive environment of drilling in rock.

A wide range of abrasive particles may be used in the process of this invention, most suitably those having average diameters from about 2 microns to about 0.05 inches, preferably particles from about 10 microns to about 200 microns. Further, due to the maintenance of the solid particulates in a foam, particles having high densities may be used according to this invention. Especially suitable solids for use in this invention include abrasives such as silicon carbide, aluminum oxide, metallic slag, steel shot, chopped fibers, garnet and silica sand.

The solid particulates may be introduced in dry condition through multiple orifices into a fluid jet stream, but are preferably introduced in the form of a stable slurry or foam. To form the foam the solid particulates are first mixed with the desired liquid to form a slurry. A wide variety of organic or inorganic liquids may be used, such as water, ethylene glycol, diethylene glycol, and other liquids for special purposes to form the slurry. The solid particulates may be accurately measured into a pre-measured amount of liquid to form a slurry by mixing. The solid particulates may be wetted prior to forming the slurry by first mixing the solid particles with the slurry liquid or other wetting liquid to obtain desired properties. Such wetting may be enhanced by mixing a wetting and/or dispersing agent with the solid particles or the wetting and/or slurry liquid. For example, some solids may not be wetted well by water, which is the desired slurry liquid in a particular case. In such case, the solids can be wetted first with a small amount of oil or other liquid that is known to wet the solids well and subsequently surfactant that is compatible with the wetting liquid and with water may be added to the wetted solids. The selected wetting liquid may not be miscible with water, but the addition of a selected surfactant enables each wetted solid particle to be coated with the surfactant molecules and the coated particles can then be suspended in water to form a slurry.

Suitable surfactants are well known in the art to be useful as wetting and/or dispersing agents in a wide variety of systems. Specific surfactants offer certain desired properties and advantages with certain liquid-gas or liquid-liquid or liquid-solid interfaces. The selection of a surfactant is determined by the solid particles involved, the liquid used in making the slurry, the gas used in generating the foam, and the desired amount of foam and foam stability. For example, suitable surfactants include sodium stearate, potassium stearate, stearic acids, sulfonic acids, alkyl sulfates, alkylolamides, alkyl sulfoacetates, alkyl aryl polyetheralcohols, and the like. Surfactants which are non-ionic, anionic or cationic may be used depending upon the materials used and desired properties, such as polyethylene oxides, sodium lauryl sulfates, and cetyl pyridinium chlorides, respectively. Settlement of the solid particulates in the slurry, expecially high density materials, can be avoided by adding a thickening agent. Especially suitable thickening agents are thixotropic agents. Suitable thickeners or thixotropic agents are well known in the art and common materials include sodium silicate, carboxy methyl cellulose, hydroxy ethyl cellulose, sodium carboxy methyl cellulose, polyethylene oxide, attapulgite clay, sepiolite clay, sodium bentonite, polyacrylamides, natural or modified polyssacharides such as guar gum, xanthum gum bipolymer and starch based polymers. Some of the chemicals referred to as thickening or thixotropic agents also act as foam stabilizers to prevent collapse of the foam bubbles sooner than desired and some also act as lubricating agents.

In the practice of this invention, it is suitable for the slurry to comprise about 100 to about 800 grams/liter of solids, preferably about 300 to about 500 grams/liter.

The stable slurry comprising solid particulates may then be formed into a foam by any suitable method. In one embodiment, the slurry comprising solid particulates and at least one surfactant acting as a foaming agent may be placed in a pressure vessel with a propellent. Release of the mixture from the pressure vessel instantly generates the desired foam which may then be readily transported. Various propellents are well known to the art and suitable for use in the process of this invention, such as air, carbon dioxide, propane, butane, and fluorinated hydrocarbons. Another means of forming a suitable foam is by mixing a stream of the slurry containing a foaming agent with a stream of gas, such as air, to generate a foam. This method is widely used in various spraying processes. In both of the above described methods for forming the foam, the foam is generated as a result of the action of the foaming agent or surfactant with the gas.

In another embodiment of forming foam according to the process of this invention, an in situ blowing agent may be added to the slurry and activated as desired. The activation of the blowing agent is usually accomplished by heat or by a catalyst. The bubbles produced by such blowing agents include nitrogen, carbon dioxide or other gases, depending upon the blowing agent used. Blowing agents are well known such as sodium bicarbonate and many blowing agents used in the manufacture of foam rubber and plastics including p-toluene sulfonyl hydrazide, marketed by Uniroyal, Inc. under the term Celogen TSH and azoalkenes, such as those marketed by Penwalt Corporation under the name Lucel. The amount of gas produced by each type of blowing agent is precisely known and thus the bubble size generated can be well controlled.

In one preferred embodiment of the process of this invention, abrasive water jets are formed which are capable of cutting hard rock containing materials. In such cases, commonly used abrasives, such as silicon carbide, aluminum carbide, garnet and fine sand are all readily wetted with water and a wide variety of surfactants suitable for forming thixotropic slurries and for use as foaming agents are well known for water based systems. Such an aqueous abrasive slurry can be stored, easily handled and easily transported. Propellents can be added to the slurry which will provide instant generation of aqueous abrasive foam by either being stored in pressurized vessels or by pressurizing the vessel at time of use with compressed air. Releasing of the pressure results in the foam. In another embodiment, the aqueous abrasive slurry can be pumped to the fluid jet apparatus as a slurry and mixed with a gas stream to generate the foam just prior to mixing with the fluid jet. In either case, the abrasive solid particulates are in the form of a stable slurry or a stable foam, the particles being homogeneous throughout the system and greatly reducing erosion problems as compared with prior systems which used gaseous streams to transport the solids. Another advantage of use of abrasive-containing foam in the hole drilling application of this invention is the added assistance of the gas in raising the earth and rock particles to the surface through the drilled hole.

An important aspect of this invention is the use of nozzles suitable for proper mixing of solid particulates with fluid jet streams and particularly mixing foam containing abrasives with a high pressure fluid jet stream to form and maintain the desired shape high velocity abrasive-fluid jet stream. The nozzles disclosed herein also can be advantageously used in the formation of high velocity particulate containing fluid jet streams utilizing stable slurries of abrasives.

Figure 6:
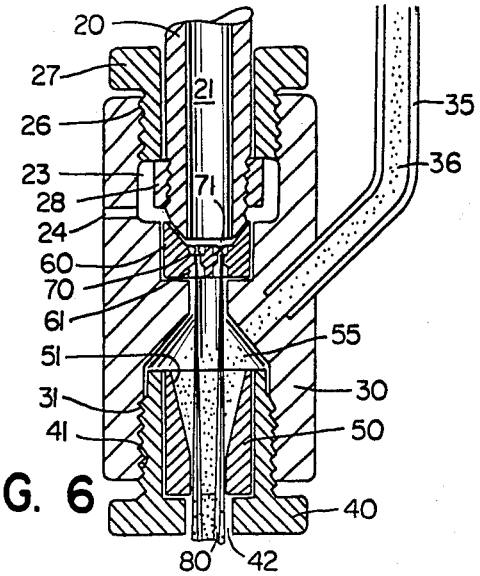
FIG. 6 is a cross-sectional view of an abrasive-fluid jet nozzle assembly for use in one embodiment of this invention.
Figure 7:
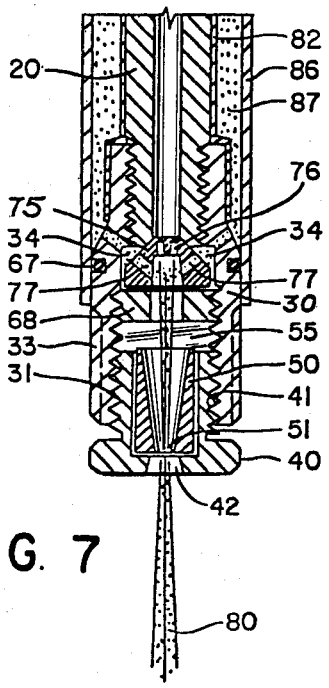
FIG. 7 is a cross-sectional view showing another abrasive-fluid jet nozzle with an integrated orifice cone for use in this invention.

In one embodiment, the apparatus of this invention uses a fluid-solid mixing nozzle generally shown in FIG. 6 which may be incorporated in a rotary drill bit comprising nozzle body 20 defining pressurized fluid chamber 21 and capable of withstanding internal fluid pressures used; an orifice support cone 60 and orifice plate 70 as shown in FIG. 6, or an orifice cone 75 as shown in FIG. 7; a flow shaping cone 50 for facilitating the combination of the solids in the fluid stream and shaping the fluid stream; pressurized fluid inlet means through chamber 21; solids feed means 35; and a nozzle assembly means 40 permitting disassembly of the flow shaping cone for cleaning and/or replacement.

Referring specifically to FIG. 6, nozzle body 20 forms pressurized fluid chamber 21 capable of maintaining desired high fluid pressures. The pressurized fluid is introduced into pressurized fluid chamber 21 from the top. It is also preferred that the walls of fluid chamber 21 have smooth surfaces to minimize fluid turbulence. Orifice plates 70 having orifice 71 shaped for generating a substantially coherent fluid jet is mounted on top of support cone 60. Orifice plates 70 are preferably made from a hard material, such as hardened steel, hard ceramics, tungsten carbide, diamond, ruby or sapphire. Orifices of such materials have a long lifetime, withstand high fluid pressures, and can be made by methods known to the art to very high precision standards. Materials such as hardened steel and tungsten carbide are suitable for lower pressures and less critical applications. Support cone 60 has through passages 61 aligned with orifice 71. Support cone 60 is held tightly against nozzle body 20 by nozzle cap 30 being threadedly engaged with gland nut 27 and collar 28. A tapered fit between support cone 60 and nozzle body 20 centers support cone 60. Nozzle nut 40 with through passage 42 is threadedly engaged with the lower end of nozzle cap 30 and holds loosely fitting flow shaping cone 50. In the embodiment shown in FIG. 6, abrasive feed means 35 with abrasive feed passage 36 provides abrasive to mixing chamber 55 above flow shaping cone 50. Flow shaping cone 50 has through passage 51 which is a tapered bore in which the solid particles are mixed with the fluid jet. The exit of through passage 51 is sized according to the diameter of the fluid jet at that location, the threaded nozzle nut 40 allowing some adjustment to the size relationship between the fluid jet and the cross-sectional area of flow shaping cone 50. Having the loose fit, flow shaping cone 50 will align itself with the fluid jet so that it is properly centered. The high velocity particulate containing fluid jet 80 leaves the apparatus through nozzle nut through passage 42.

FIG. 7 shows another embodiment of an abrasive-fluid nozzle for use in this invention having orifice cone for mixing of the solid particulates with the fluid stream. The high velocity particulate containing fluid jet nozzle shown in FIG. 7 shows orifice cone 75 with multiple fluid orifices 76 which may generate substantially parallel jets or converging fluid jets which are particularly advantageous for mixing with foam containing particulates introduced by multiple abrasive orifices 77. Various embodiments of orifice cone 75 are further disclosed in FIGS. 8–12 and the more detailed description to follow. As shown in FIG. 7, the abrasive enters through abrasive chamber 87 an annular cavity surrounding nozzle body 20 and defined by outer tube 86. Protective sleeve 82 is shown surrounding nozzle body 20 to avoid erosion of the nozzle body by the abrasive particles. Cross linked polyethylene or other suitable materials may be used for such a protective sleeve. Abrasive chamber 87 may be sealed at its lower end by O-ring seal 67. Orifice cone 75 is tightly engaged against the end of nozzle body 20 by orifice cone retaining nut 68 threadedly engaged with nozzle cap 30. In a manner as described with respect to FIG. 6, flow-shaping cone 50 is retained by nozzle nut 40 screwedly engaged with nozzle cap 30.

Figure 8:
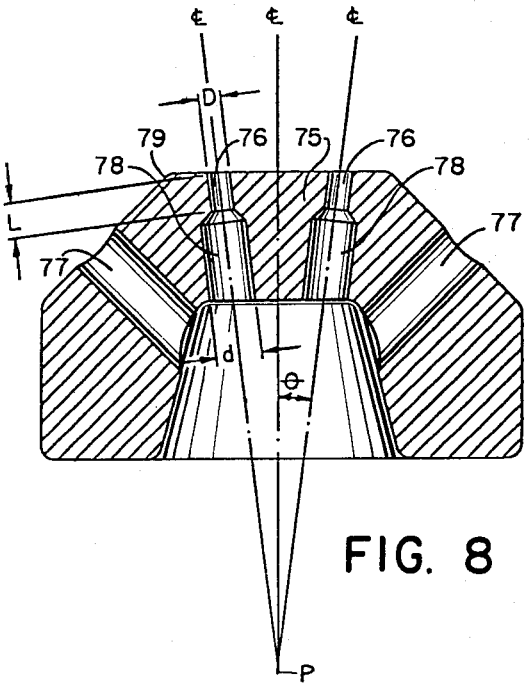
FIGS. 8 and 9 are cross-sectional views showing different embodiments of orifice cones for use in this invention.
Figure 13:
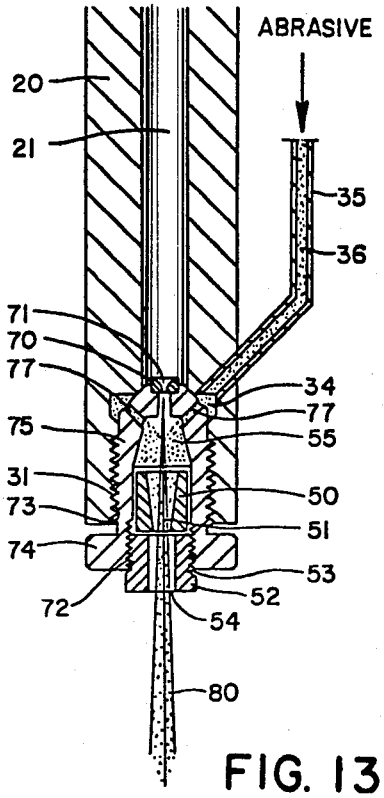
FIG. 13 is a cross-sectional view showing another embodiment of an abrasive-fluid jet nozzle for use in this invention.

FIG. 8 is an enlarged cross-sectional view of one embodiment of an orifice cone suitable for use in this invention. In this embodiment, multiple fluid orifices 76 and fluid orifice outlets 78 are drilled directly through the top of cone 75. Two or more converging fluid orifices may be used. Abrasive orifices 77 are drilled directly through the orifice cone tapered walls. Tapered side walls 79 are suitably tapered in the portion between abrasive orifices 77 and fluid orifices 76 to seat tightly against the tapered bottom of nozzle body 20. The inlet to abrasive orifices 77 is in communication with abrasive chamber 87 as shown in FIG. 7 or directly by abrasive feed means 35 as shown in FIG. 13. The center lines of the individual fluid orifices 76 converge at a point P which is on the center line of the orifice cone. The angle of the converging fluid orifices 76 with the center line of orifice cone 75 is suitably about 3° to about 10°. Fluid orifices 76 are shaped such that the length of the flow restriction, L, is about 1 to about 4 times the diameter of the restricted portion, D. The lower portion of the fluid orifice has an enlarged portion 78 having a diameter, d, sufficiently large so as to not interfere with the fluid jet formed in the fluid jet portion 76.

Figure 9:
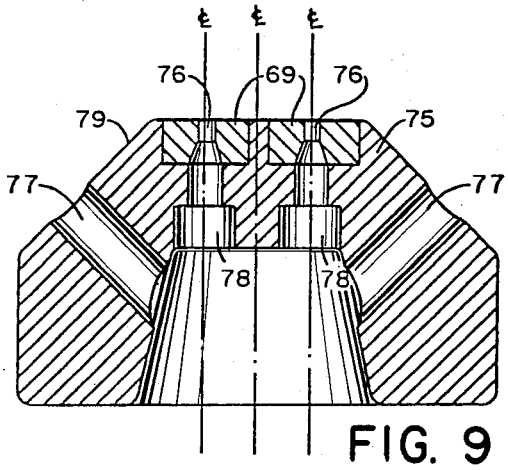

FIG. 9 shows another embodiment of an orifice cone for use in this invention wherein the center lines of multiple fluid orifices 76 are parallel to the center line of orifice cone 75. As shown in FIG. 9, separate orifice plates 69 may be mounted in recesses in the top of orifice cone 75 providing replacement of orifice plates and easier fabrication by avoidance of precision drilling of the orifice cone. The orifice cones useful in this invention may be drilled directly to provide fluid orifices 76 or may have separate orifice plates set in retaining receptacles in orifice cones. The orifice cone 76 may have abrasive orifices directly drilled through the side of the orifice cone, as shown in FIG. 9, or have the abrasive orifices drilled through the nozzle cap 30, as shown in FIG. 6.

Figure 10:
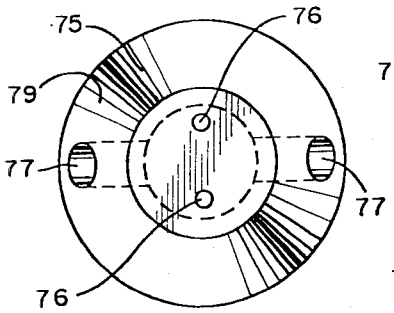
FIGS. 10, 11 and 12 are top views of different embodiments of orifice cones.
Figure 11:
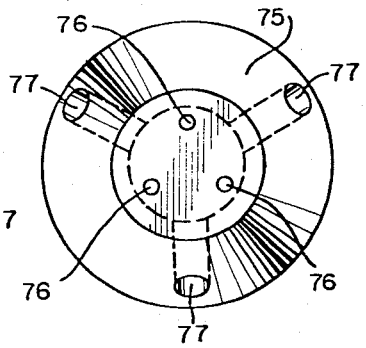
Figure 12:
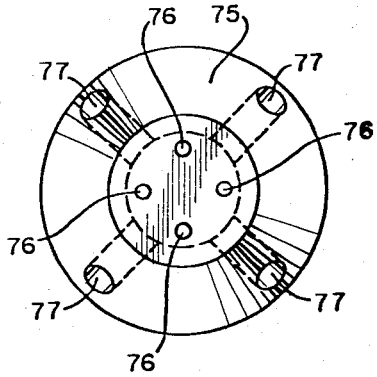

FIGS. 10 through 12 show top views of various embodiments of orifice cones useful in this invention. Particularly suitable orifice cones are those having two or more fluid orifices and two or more abrasive orifices for better mixing of the abrasive particulates with the fluid jet. Any number and combination of orifices for enhancing the desired mixing may be used, dictated primarily by the diameter of orifices and the orifice cone at the top, preferably from 2 to 8 and particularly preferred are 3 to 6 orifices positioned in a circular pattern with equal angular spacing and with the same number of orifices for each fluid and particulates. FIGS. 10 through 12 show specific configurations suitable for 2, 3 and 4 orifice cones according to preferred embodiments of this invention. As shown in FIGS. 10–12, one particularly advantageous arrangement of multiple fluid and particulate jets is to space the particulate jets on an arc midway between the fluid jets. Such an arrangement enhances the mixing of solids with the fluid jets. The orifice cones are preferably made of hardened stainless steel, tungsten carbide, hard ceramics, sintered ceramics such as high purity aluminum oxide, and the orifice plates 69 are preferably made of ruby, sapphire, hard ceramics, or other hard orifice materials having the desired dimensions and orifice geometry.

The multiple converging fluid jets created by the orifice cone shown in FIG. 8 and the parallel fluid jets created by the orifice cone shown in FIG. 9 create a central volume of the fluid jets of reduced pressure into which the abrasive particles can be mixed by the natural powerful suction produced by the fluid motion. Because of the dispersion of the fluid jets, the parallel fluid jets will be in contact with one another or will converge into a single jet downstream from the fluid orifices. The flow shaping cone 50 in the nozzle assembly allows some control on the convergence of the multiple parallel fluid jets. The multiple fluid jets generate suction which may be used to transport the particulate solids or solids containing foam into the solids chamber 34 from a distant reservoir and is useful to mix the solids into the liquid jets. The converging fluid jets, as shown in FIG. 8, can advantageously be used to form different shaped jets, such as a fan-shaped abrasive fluid jet, for cutting wide grooves and for removing materials from a large surface area. Another means for forming multiple fluid jets is to provide a single orifice plate as shown in FIG. 6 with multiple orifices. In each case, a suitable flow shaping cone must be used with the particular orifice or combination of orifices to obtain the best results.

Another embodiment of a suitable high velocity abrasive containing fluid jet nozzle for use in this invention is shown in FIG. 13 wherein orifice cone 75 is shown with external threads 73 for engaging orifice cone 75 directly with the lower portion of nozzle body 20. This embodiment is particularly suited for screwing the nozzle assembly into the face of a rotary drill bit. In this embodiment, suitable fluid jets are provided by orifice plate 70 with orifice 71 and solid particulates supplied by solids feed means 35 are supplied to solids chamber 34 for feeding through solids orifices 77 into mixing chamber 55. The orifice cone 75 can also have multiple orifice plates 70 to generate multiple jets. Flow-shaping cone 50 is loosely retained within the bottom portion of orifice cone 75 by being threadedly engaged with flow-shaping cone support nut 52 having through passage 54. The lower portion of orifice cone 75 has orifice cone flange 74 for readily tightening orifice cone 75 into nozzle body 20. Flow-shaping cone support plug allows flow-shaping cone 50 to be raised or lowered by turning of support plug 52.

Figure 14:
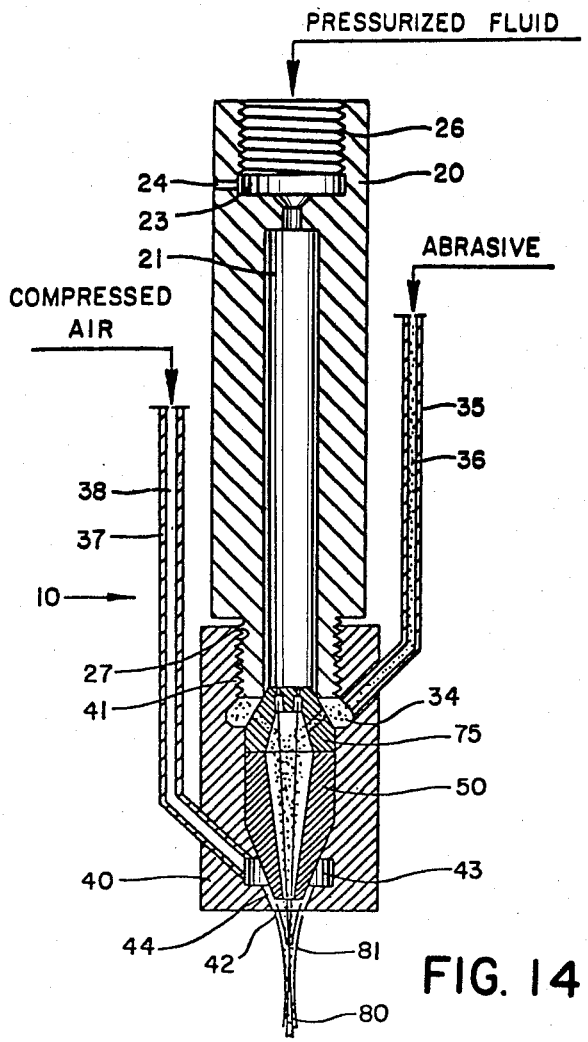
FIG. 14 is a cross-sectional view showing another embodiment of a nozzle suitable for the abrasive-fluid jet utilizing compressed air to form a shroud around the abrasive-fluid jet for use in this invention.

FIG. 14 shows another embodiment of a nozzle for use in this invention wherein nozzle nut 40 is threadedly engaged with the lower portion of nozzle body 20 and retains orifice cone 75 and flow-shaping cone 50 within a cavity of nozzle nut 40. The embodiment shown in FIG. 14 additionally has compressed air feed means 37 with passage 38 providing compressed air to air chamber 43 within nozzle nut 40 arranged, together with the external shape of flow-shaping cone 50 and nozzle nut through passage 42, to provide annular air passage 44 forming air shroud 81 around particulate containing fluid jet 80. This embodiment is particularly useful when an abrasive fluid jet is used under submerged conditions to isolate the abrasive water jet at the nozzle exit from surrounding water, thus minimizing interfering effect of the surrounding water. The use of wet abrasive foam according to this invention further enhances the advantage of this invention in submerged applications.

Generally, the prior art nozzles utilize a long conical nozzle or Venturi to force the particulates, water and air together into one jet stream. Although hard materials such as tungsten carbide, boron carbide and ceramics have been used to construct such nozzles, they have worn out quickly. The prior art nozzles have been rigidly attached to the nozzle body by threaded or bolted arrangement making concentricitiy of fluid streams critical. Lack of concern in prior art devices of the relative size of fluid streams and nozzle openings and on the position of this nozzle and its throat length have further reduced the effectiveness of the prior nozzles in generating suction and in entraining abrasives. It is not uncommon in current practices that a nozzle made of very hard boron carbide wears out quickly as the abrasive-bearing fluid stream actually impinges on the nozzle itself. The use of oversized or undersized nozzles in current practices is a common occurrence. The nozzles used in this invention give attention to this portion of the nozzle, which is termed a flow-shaping cone. In the present nozzles, the flow-shaping cone is preferably loosely fitted inside a holder and is thus capable of aligning itself with the fluid jets. The flow-shaping cone is made of selected materials according to the jet configurations and intended applications. The flow-shaping cone used in the present nozzles is made of hard and abrasion-resistant materials. The preferred materials for heavy duty applications are tungsten carbide, silicon carbide, boron carbide and sintered ceramics. The flow-shaping cone has a conical interior tapered to a short throat and may have a flared exit. The inside diameter of the throat, as well as the interior dimensions of the cone, are in proper relationship with the size of the envelope of the water jet or bundle of water jets, which is related to the jet configuration and jet dispersion. In sizing the throat opening of the flow-shaping cone, it is desirable that the cone just touches the edge of the fluid jet such that fluid droplets are deflected toward the core of the fluid jets and the fluid jets are slightly deformed to form an envelope around the circular throat. Such arrangement can also keep the escape of unentrained abrasive particles to a minimum and generate very strong suction at the center of the bundle of circularly positioned fluid jets. Ideally, all the abrasive particles should be entrained into the fluid jets at the center of the bundle of fluid jets so that maximum particle entrainment and minimum wear of flow-shaping cone can be achieved. The jet configuration and dispersion are determined by the characteristics and configuration of orifices, fluid pressure and characteristic of the fluid. The longitudinal position of the flow-shaping cone in relationship to the fluid jet is purposely made adjustable in the abrasive-fluid jet nozzles used in this invention. Thus, the position of the throat can be strategically placed such that it will not interfere with the fluid jets while limiting the escape of abrasives around the fluid jet to a minimum. By sizing the length and the inside diameter of the throat of the flow-shaping cone as described and by positioning the cone according to jet dispersion, a very strong suction can be generated by the fluid jets. Such suction action can effectively entrain solid particles into the fluid jet and accelerate them to high speed.

Figure 15:
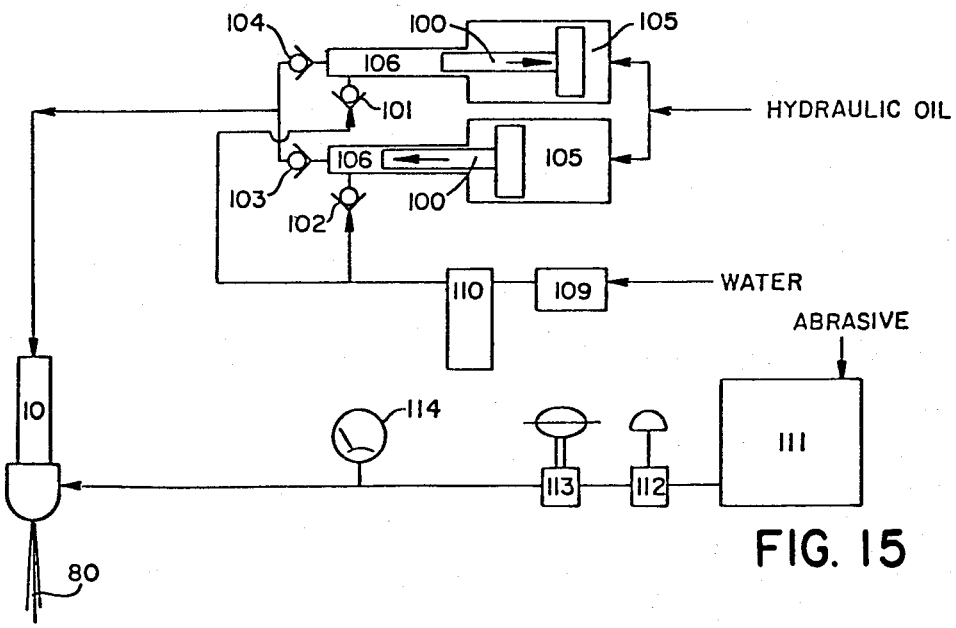
FIG. 15 is a diagrammatic showing of the principal components of a fluid and abrasive supply system for use in this invention.

FIG. 15 illustrates schematically the components of the abrasive and fluid supply for use of the apparatus of this invention. Fluid pressure intensifier means to generate suitable fluid pressure for the specific use for which the system is designed may be used. For higher pressures, dual fluid pressure intensifiers driven by hydraulic oil are suitable. Also suitable for high pressures are triplex positive-displacement piston pumps driven by a prime mover, such as an engine or an electric motor connected to the pump through a speed reducing means. A preferred embodiment is shown in FIG. 15 wherein dual fluid pressure intensifiers 100 are driven by a pressurized hydraulic oil or fluid passing into hydraulic cylinder 105. Water or other fluid to be pressurized for the fluid jet is provided from a supply means by pump 109 through filter 110 and check valves 101 and 102 to fluid cylinders 106 for pressurization. The pressurized fluid passes from fluid cylinders 106 through check valves 103 and 104 to mixing nozzle 10. Abrasives may be stored in a slurry or foam form in solids tank 111 and their passage to the fluid-solid mixing nozzle 10 controlled by solids valve 112. In one embodiment solids are stored in foam form in solids tank 111 and passage to fluid-solid mixing nozzle 10 is controlled by valve 112 and pressure regulator 113 with pressure gauge 114. In a preferred embodiment, the hydraulic fluid is supplied by a conventional hydraulic power source to dual pressure intensifiers which are operated in opposing synchronism to avoid pressure fluctuations at the output and eliminate the need for a high pressure accumulator. By use of such pressure intensifiers liquid can be obtained at pressure levels as high as 60,000 psi. Abrasive water jets with suitable abrasive foams according to this invention formed using up to 60,000 psi water are able to perform desired cutting of rock. Many applications of the abrasive water jet of this invention will not require water jets of these pressures, but will require liquid pressures in the order of 10,000 to 30,000 psi which may be obtained from direct driven plunger or piston pumps which are commercially available.

In tests performed, abrasive waterjets can cut soft, isotropic, permeable rock very effectively at a modest water pressure of a few thousand pounds per square inch; even very hard rock such as quartzite, basalt and granite can be cut with suitably formed abrasive water jet at pressures in the order of 10,000 to 20,000 psi. In drilling applications, however, there will be fluid pressure at the bottom of a hole and the effective cutting pressure will be the difference between the supply fluid pressure at the nozzle and the downhole ambient pressure, the so-called pressure differential. The magnitude of downhole ambient pressure is governed basically by the depth of the hole and the specific gravity of the fluid involved. For a hole of several thousand feet in depth, the downhole ambient pressure can be in the order of several thousand pounds per square inch.

With pure fluid jet drilling, it has been reported (Pols, A.C., "High Pressure Jet-Drilling Experiments in Some Hard Rock", paper ASME 70-Pet-50 presented at the ASME Petroleum Mechanical Engineering and Pressure Vessels and Piping Conference, Mexico City, Sept. 19–24, 1976) that a pressure differential of more than 14,500 psi was required to drill hard rock. This would make the supply fluid pressure up to and beyond 30,000 psi necessary in deep drilling to compensate for the pressure drop through the pipe and downhole ambient pressure. With abrasive-entrained waterjet or fluid jet, the required pressure differential can be reduced significantly. Currently available test data (Yie, G. G., National Science Foundation Project CEE-8260224, "Hard Rock Cutting with Abrasion Jet") showed that very hard granite can be cut with abrasive waterjet at 10,000 psi or less, thus reducing the required supply fluid pressure to 20,000 psi or less. This reduced supply pressure can significantly ease the requirement of pumping and transporting the fluid downhole as suitable pumps and hoses are available for such pressure range. The rotary drill bits and process of this invention with multiple abrasive-fluid jet nozzles operate effectively with fluid pressure differentials of 10,000 psi and less.

The following examples setting forth specific materials, quantities, sizes, and the like are for the purpose of more fully understanding very specific embodiments of the invention and are not meant to limit the invention in any way.

EXAMPLE I

This example shows one preferred process for formulating an abrasive foam for use in this invention. Twenty-five grams of sodium bentonite powder were added slowly into 300 ml of tap water with stirring until all the sodium bentonite particles were uniformly suspended in water to form a colloid. This mixture was allowed to stand for 24 hours fully hydrating sodium bentonite to form a gel. This gel was thixotropic in nature providing a gel structure which breaks down readily when shearing or stirring so that the gel became fluid and pumpable with gelling occurring again shortly after the sodium bentonite slurry was allowed to stand undisturbed. The apparent viscosity of the gel and the viscosity of the colloid upon stirring were a function of the amount of sodium bentonite added, too much sodium bentonite rendering the colloid too heavy for pumping.

Four hundred (400) grams of aluminum oxide powder having the grid number of 220 (average particle size—50 microns) were slowly added to the sodium bentonite colloid under agitation until all the abrasive powder were evenly distributed throughout a slurry. The apparent viscosity of this mixture was quite high even under stirring. If agitation was stopped and the mixture was allowed to stand undisturbed, some of the aluminum oxide grains would settle to the bottom. The settled aluminum oxide particles can pack into hard cake, making it very difficult to suspend the settled particles again.

Lanthanol LAL-70, sodium lauryl sulfoacetate, supplied as 70 percent active reagent in powder form and marketed by Stepan Chemical Company, was added as a foaming agent to the water-sodium bentonite-aluminum oxide slurry shortly after the addition of aluminum oxide powder. This foaming agent was added to the abrasive slurry in solution form made by dissolving 3.5 grams of the foaming agent powder in 100 ml tap water. A total of 50 ml of foaming agent solution were added to the abrasive slurry with agitation. Numerous small air bubbles immediately formed in the slurry and the apparent viscosity of the resulting foamed abrasive slurry was significantly reduced as a result of the foaming action.

The foamed abrasive slurry exhibited characteristics that are particularly advantageous to the process of this invention. The viscosity of the foamed abrasive slurry under agitation was significantly less than the abrasive slurry before the addition of the foaming agent. However, when the foamed abrasive slurry was undisturbed, the slurry would still settle into a gel without losing the air bubbles such that the heavy aluminum oxide particles, specific gravity 3.9, will not settle to the bottom of the container even after prolonged storage. Once agitated, the foamed abrasive slurry became easily pumpable and was fluid enough to flow through plastic tubing of $\frac{1}{8}$ inch inside diameter under low pressure with no visible separation of the abrasive particles occurring in the tubing. When the foamed abrasive slurry contacted a small stream of water, the foam bubbles broke down readily and the abrasive particles washed away with the water stream.

EXAMPLE II

A nozzle having the basic design as shown in FIG. 6 was constructed having the cylindrical nozzle cap made of stainless steel of the type commonly used for constructing pressure vessels and fittings. The nozzle cap has an external diameter of 2.50 inches and internal threads on both end cavities which are joined by a central passage of 0.25 inch in diameter. The threaded cavities are 0.75 inch in diameter. The upper threaded cavity has a total depth of 1.25 inch and has a circular recess to receive a support cone, as shown in FIG. 6. The lower threaded mixing chamber cavity has a depth of 1.0 inch and has a coned entrance from the central passage connecting the two cavities. The nozzle body is a high pressure stainless steel tube of 9/16 inch external diameter and 0.312 inch internal bore having a smooth internal surface. The lower end of the nozzle body is threadedly engaged to a tube collar and has tapered end to mate with the support cone. The nozzle body is tightly held against the support cone mounted in the nozzle cap by a gland nut in an arrangement typically used in high pressure connections. The support cone with upper tapered interior wall of about 60° to fit the tapered end of the nozzle body is made of stainless steel. The exterior diameter of the support cone is 0.60 inch, its interior flat surface is 0.30 inch in diameter, and its overall height is 0.40 inch. The top flat surface of the support cone has 5 circular recesses to accommodate 5 circular orifice plates arranged in a circle with 72° spacing. A tapered central passage having a diameter of 0.40 inch at the top and 0.60 inch at the bottom extends through the support cone from each circular recess.

Five orifice plates were made of sapphire in the form of circular disks 0.09 inch in diameter and 0.05 inch in thickness. A single cone-shaped orifice is situated at the center of each orifice disk. This orifice has an 80° taper at top and a straight orifice at bottom, with the internal surface being very smooth. The diameter of the orifice is about 0.060 inch at top and 0.023 inch at bottom and the length of the straight section of the orifice about 0.030 inch. Silicone adhesive is used to mount the orifice plates into the recesses of the support cone and to provide a seal.

A flow shaping cone was made of sintered ceramics for hardness and abrasion resistance and is a cylindrical cone 1.00 inch long with an outside diameter of 0.60 inch. The flow shaping cone has a tapered internal through passage of 0.48 inch diameter at top and 0.25 inch at bottom. This cone fits loosely in the cavity of a nozzle nut, which is made of stainless steel and screws into the lower cavity of the nozzle cap. The nozzle nut can be rotated to adjust the distance of the flow shaping cone from the orifice plates so the exit of the flow shaping cone is slightly larger than the bundle of fluid jets.

An angled 7/32 inch diameter hole through the nozzle cap places the solid mixing chamber in communication with the solid feed means by a 0.50 inch diameter plastic tube for introducing abrasives into the mixing chamber.

The described nozzle assembly is capable of withstanding fluid pressure up to 20,000 psi at room temperature and of delivering 5 to 6 gallons per minute of fluid such as water at the maximum pressure. The five jets issued by this nozzle assembly are essentially parallel to each other and will converge downstream to form a single jet stream because of the natural dispersion of each jet. By moving the nozzle nut up and down, it is possible to situate the flow shaping cone such that the exit opening of the flow shaping cone is only slightly larger than the outside diameter of the waterjet bundle at the location under a given fluid pressure. Because of the loose fit, the flow shaping cone will align itself to the waterjets so as to minimize the wear on the cone exit. By so doing, little or no abrasives flow out around the waterjets and a very high negative pressure can be generated inside the mixing chamber, thus enhancing the introduction and entrainment of abrasives into the jet stream; consistent negative pressure of 28 to 30 inches Hg was obtained with the nozzle assembly described.

The abrasive containing waterjets formed by this nozzle were found to be capable of cutting hard concrete and rock at water pressures below 20,000 psi. For example, using the 5-parallel-jet nozzle described and moving the nozzle at 1 foot per minute speed over a rock specimen at 60 hp pump power input and 15,000 psi water, a cut of more than 1.0 inch in depth was achieved with hard rock such as quartzite, basalt and granite. Such results were obtained with garnet grains as abrasives at a consumption rate of less than 1.5 pound per minute. As a comparison, pure waterjet at the identical water pressure and nozzle traverse speed can only scratch the surface of such hard rock to a depth of less than 0.1 inch in depth. When the abrasive waterjet described herein was applied to a hard rock in a stationary position, a deep hole can be drilled quickly. For example, a hole of 0.5 inch in diameter and 2.5 inch in depth was made in a hard quartzite rock by the abrasive waterjet in 14 seconds. When the abrasive-fluid jet nozzles are mounted in rotary drill bits holes of any desired size can be made in rock by rotating the rotary drill bit as described herein against the rock at suitable speed. When two or more abrasive waterjet nozzles as described herein are positioned concentrically in a drill bit and rotated with the waterjets directed against a rock, concentric circular cuts of considerable depth can be obtained and concentric ridges of rock are formed, such rock ridges being readily fractured and removed with drag bits or disk cutters using very modest force. Some of the rock ridges or portions of the ridges can be removed by the abrasive fluid jets themselves if they are angled to undercut such ridges.

Since the abrasive waterjet rotary drill bits described above require a fluid pressure of less than 15,000 psi to cut very hard rock, abrasive waterjet drilling can be applied downhole to great depths using commercially available pumps and hoses. Furthermore, such moderate fluid pressures can also significantly ease the design and construction of swivel joints and increase the durability of seals in the drilling apparatus.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. Apparatus for drilling holes in rock comprising:

a rotary drill bit having multiple abrasive-fluid jet nozzles mounted in the face of said bit having their center of flow at about 20 to about 90 degrees to said face and spaced to cut concentric grooves in said rock upon rotation, and mechanical cutters mounted in said face of said bit and spaced between said fluid jet nozzles to remove remaining material between said grooves upon rotation;

a stationary drill head housing torque generation means and rotary mounting means holding said rotary drill bit beneath and in rotatable relation to said drill head;

high pressure liquid supply means for supplying pressurized liquid through flexible hoses to liquid orifices in a central portion of each said abrasive-fluid jet nozzles at over 10,000 psi; and abrasive supply means for supplying through flexible hoses abrasive separate from and downstream from the supply of said liquid and peripheral to the central portion of each said abrasive-fluid jet nozzles.

2. Apparatus of claim 1 wherein said abrasive supply means comprises a ground surface abrasive slurry forming means and flexible hoses for supply of said slurry to said stationary drill head.

3. Apparatus of claim 1 wherein said abrasive supply means comprises a ground surface abrasive foam forming means and flexible hoses for supply of said foam to said stationary drill head.

4. Apparatus of claim 3 wherein said liquid supply means comprises a ground surface pump capable of providing said liquid at pressures up to about 20,000 psi and flexible hoses for supply of said liquid to said stationary drill head.

5. Apparatus of claim 1 wherein said liquid supply means comprises a ground surface pump capable of providing said liquid at pressures up to about 20,000 psi and flexible hoses for supply of said liquid to said stationary drill head.

6. Apparatus of claim 1 wherein said torque generation means comprises an electric motor within said stationary drill head driving said rotary drill bit through gear means.

7. Apparatus of claim 1 wherein said torque generation means comprises pressurized liquid torque generation means comprising a rotor means in non-rotatable relation extending upwardly from the top of said drill bit, high pressure cylinder means surrounding said rotor, high pressure sealing means at one end of said cylinder means, said liquid supply means in communication with one end of said cylinder means and said abrasive-fluid jets in communication with the other end of said cylinder means, pressured liquid passing through said cylinder means causing rotation of said rotor and said drill bit.

8. Apparatus of claim 7 wherein said cylinder means extends upwardly from the top of said drill bit and said high pressure sealing means is in the upper portion of said cylinder means.

9. Apparatus of claim 7 wherein said cylinder means extends downwardly from the upper portion of said drill head housing and said high pressure sealing means is in the lower portion of said cylinder means.

10. Apparatus of claim 7 wherein said rotor means comprises a rotary screw.

11. Apparatus of claim 1 wherein said abrasive-fluid jet nozzles have their center of flow at about 45 to about 90 degrees to said face.

12. A process for drilling holes in rock comprising:

forming multiple fluid jet streams comprising abrasive particles in multiple nozzles spaced in the face of a rotary drill bit, said abrasive-fluid jet streams jetting from said nozzles at about 20 to about 90 degree angles to said face, said abrasive particles supplied through flexible hoses to a peripheral portion of each said nozzles separate from liquid pressurized to over 10,000 psi supplied through flexible hoses to liquid orifices in a central portion of each said nozzles;

rotating said rotary drill bit in relation to an adjacent stationary drill head by a torque generation means within said drill head, said rotating drill bit with said abrasive-fluid jet streams cutting concentric grooves in said rock and removing rock between said grooves by mechanical cutters spaced on the face of said rotary drill bit between said fluid jet nozzles.

13. The process of claim 12 wherein the thrust for said drill bit is provided by the combined weight of said rotary bit, said stationary drill head and flexible conduits supplying said abrasive particles and said pressurized fluid.

14. The process of claim 12 wherein said abrasive particles are mixed to form an abrasive slurry at the ground surface and said abrasive slurry is supplied by flexible hoses to said stationary drill head.

15. The process of claim 12 wherein said liquid is pressurized up to about 20,000 psi by ground surface pumps and supplied by flexible hoses to said stationary drill head.

16. The process of claim 12 wherein torque for rotating said rotary drill bit is provided by passing said pressurized liquid through a high pressure cylinder means surrounding a rotor means in non-rotatable relation extending upwardly from the top of said drill bit within said stationary drill head whereby said pressurized liquid passing through said cylinder means causes rotation of said rotor and said drill bit.

17. The process of claim 12 wherein said rotor means comprises a rotary screw.

18. The process of claim 12 wherein said abrasive-fluid jet streams jet from said nozzles at about 45 to about 90 degrees to said face.

19. Apparatus for drilling holes in rock comprising:

a rotary drill bit having multiple abrasive-fluid jet nozzles mounted in the face of said bit having their center of flow at about 20 to about 90 degrees to said face and spaced to cut concentric grooves upon rotation, and mechanical cutters mounted in said face of said bit and spaced between said fluid jet nozzles to remove remaining material between said grooves upon rotation;

a stationary drill head housing torque generation means and rotary mounting means holding said rotary drill bit beneath and in rotatable relation to said drill head;

abrasive supply means for supplying abrasive to said abrasive-fluid jet nozzles;

fluid supply means for supplying pressurized fluid to said abrasive fluid jet nozzles separate from the supply of abrasive to said abrasive-fluid jet nozzles;

each said abrasive-fluid jet nozzle comprising a central pressurized fluid chamber in communication at one end with said pressurized fluid supply means and fluid orifice means capable of forming at least one fluid stream at the other end of said chamber; abrasives inlet means comprising mulitple orifices positioned at an angle to the axis of and peripheral to said fluid orifice means providing said abrasives passing through said abrasives inlet means mix with said fluid jet; and a flow shaping nozzle having a tapered converging through passage shaped and positioned for said fluid jet stream comprising solid abrasive particulates to pass through the throat of said flow shaping nozzle, said throat being substantially at the periphery of said abrasive-fluid jet stream.

20. A process for drilling holes in rock comprising:

forming multiple fluid jet streams comprising abrasive particles in multiple nozzles spaced in the face of a rotary drill bit, said abrasive-fluid jet streams jetting from said nozzles at about 20 to about 90 degree angles to said face, said abrasive particles supplied to said nozzles separately from pressurized fluid, each said multiple nozzles forming at least one fluid jet stream by introducing said abrasive particles through multiple orifices at an angle to and peripheral to said fluid jet stream, mixing said abrasive particles with said fluid jet stream, and passing said mixed abrasive particulate-fluid jet stream through a converging flow shaping nozzle, the throat of said flow shaping nozzle confining the output of said mixed abrasive-fluid jet stream; and rotating said rotary drill bit in relation to an adjacent stationary drill head by a torque generation means within said drill head, said rotating drill bit with said abrasive-fluid jet streams cutting concentric grooves in said rock and removing rock between said grooves by mechanical cutters spaced on the face of said rotary drill bit between said fluid jet nozzles.

* * * *